US008966717B2

(12) United States Patent
Chen

(10) Patent No.: US 8,966,717 B2
(45) Date of Patent: Mar. 3, 2015

(54) SAFETY CORD CONNECTOR FOR WINDOW BLIND

(76) Inventor: Chin-Fu Chen, Taichung (TW)

( * ) Notice: Subject to any disclaimer, the term of this patent is extended or adjusted under 35 U.S.C. 154(b) by 426 days.

(21) Appl. No.: 13/196,234

(22) Filed: Aug. 2, 2011

(65) Prior Publication Data

US 2012/0317754 A1 Dec. 20, 2012

(30) Foreign Application Priority Data

Jun. 14, 2011 (TW) ..... 100210760 U

(51) Int. Cl.
*E06B 9/326* (2006.01)

(52) U.S. Cl.
CPC ..... *E06B 9/326* (2013.01); *E06B 2009/3265* (2013.01)
USPC ..... 24/115 F; 24/115 R; 24/128; 160/178.1 R

(58) Field of Classification Search
CPC ..... E06B 9/326; E06B 2009/3265
USPC .... 24/115 F, 115 H, 115 R, 128; 160/178.1 R
See application file for complete search history.

(56) References Cited

U.S. PATENT DOCUMENTS

| | | | | |
|---|---|---|---|---|
| 4,909,298 | A * | 3/1990 | Langhart et al. | 160/178.1 R |
| 5,208,950 | A * | 5/1993 | Merritt | 24/115 H |
| 5,345,656 | A * | 9/1994 | Merritt | 24/115 H |
| 5,504,977 | A * | 4/1996 | Weppner et al. | 24/115 R |
| 5,592,983 | A * | 1/1997 | Sartini et al. | 160/178.1 R |
| 5,671,508 | A * | 9/1997 | Murai | 24/115 K |
| 6,618,910 | B1 * | 9/2003 | Pontaoe | 24/115 H |
| 8,104,146 | B2 * | 1/2012 | Wen | 24/115 F |
| 2010/0115735 | A1 * | 5/2010 | Manvel | 24/116 A |
| 2012/0000036 | A1 * | 1/2012 | Wen | 24/115 F |
| 2012/0266416 | A1 * | 10/2012 | Lee | 24/115 F |
| 2013/0007990 | A1 * | 1/2013 | Wen et al. | 24/115 R |

* cited by examiner

*Primary Examiner* — Robert J Sandy
*Assistant Examiner* — Louis Mercado
(74) *Attorney, Agent, or Firm* — Browdy and Neimark, PLLC

(57) ABSTRACT

A safety cord connector for a window blind includes a first half shell and a second half shell combined with the first half shell in such a way that a positioning protrusion extending from an inner surface of the second half shell is inserted into a positioning notch formed on an inner surface of the first half shell so as hold the first and second half shells together. When an external force exceeding the engaging force between the positioning protrusion and the positioning notch exerts between the first and second half shells, the positioning protrusion will separate away from the positioning notch to enable the combined first and second half shells to be split from each other so as to enhance safety in use.

7 Claims, 8 Drawing Sheets

SAFETY CORD CONNECTOR FOR WINDOW BLIND

BACKGROUND OF THE INVENTION

1. Field of the Invention

The present invention relates generally to window blinds and more particularly, to a safety cord connector for a window blind.

2. Description of the Related Art

To facilitate control of opening or closing a window blind, the lift cords of the window blind are usually designed to be accessibly exposed for operation by a user. In addition, a cord connector is generally used to connect the suspended ends of the lift cords for preventing the lift cords from being intertwined so as to achieve the purpose of collecting and arranging the lift cords.

Conventionally, the lift cords are fixed to the cord connector, such that one or more loops will be formed between the two or more cords and the connector. In other words, the lift cords fixed to a conventional cord connector will become a dangerous object to a toddler or young child who plays around the window blind because the toddler's or young child's neck may be hung on the loops or wrapped by the cords accidentally. Therefore, it is desired to have a safety cord connector for a window blind.

SUMMARY OF THE INVENTION

The present invention has been accomplished in view of the above-noted circumstances. It is therefore the primary objective of the present invention to provide a safety connector for connecting two or more cords of a window blind, which will be split by an exceeding force exerting thereon into two elements connected respectively with the cords so as to enhance user safety.

To achieve the above-mentioned objective, the connector for connecting two more cords of a window blind provided by the present invention comprises a first half shell and a second half shell combined with the first half shell. The first half shell has a top with a cord hole, a bottom with a coupling portion, and an inner surface on which a positioning notch is provided. The second half shell has an inner periphery contacted with an inner periphery of the first half shell, a top with a cord hole, a bottom with a second coupling portion, and an inner surface from which a positioning protrusion extends. The second coupling portion is detachably coupled with the first coupling portion and the positioning protrusion is inserted into the positioning notch. When an external force exceeding the engaging force between the positioning protrusion of the second half shell and the positioning notch of the first half shell exerts on the safety connector of the present invention, the positioning protrusion will separate away from the positioning notch, such that the first and second half shells will be gradually separated from each other to release the coupling relationship between the first coupling portion of the first half shell and the second coupling portion of the second half shell. As a result, the initially combined first and second half shells will be eventually split from each other so as to enhance safety in use.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
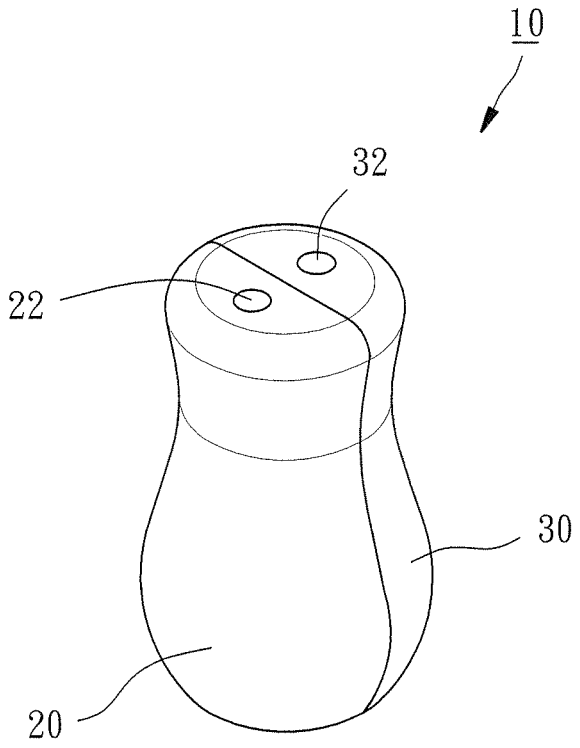
FIG. 1 is a perspective view of a connector in accordance with a first preferred embodiment of the present invention.
Figure 2:
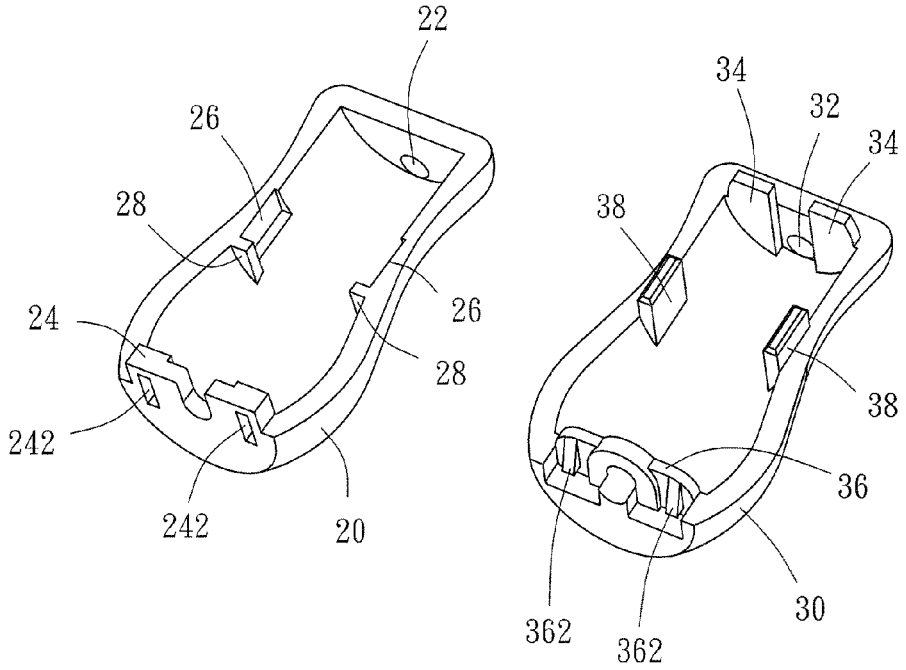
FIG. 2 is an exploded view of the connector shown in FIG. 1.

Referring to FIGS. 1-2, a safety connector 10 provided by a first preferred embodiment of the present invention is adapted to be used in cooperation with two cords of any kind of window blind. The safety connector 10 is composed of a first half shell 20 and a second half shell 30 combined with the first half shell 20.

Figure 3:
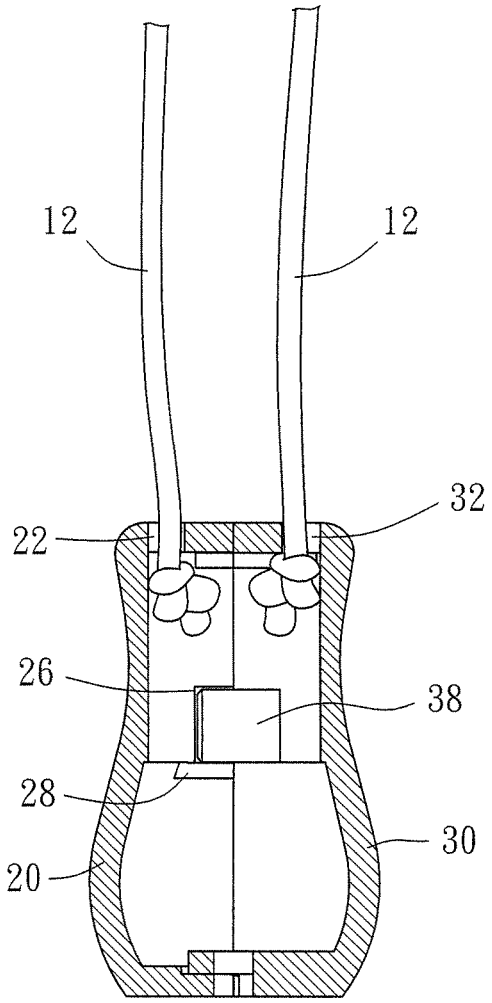
FIG. 3 is a cross-sectional view of the connector of FIG. 1, with which cords are coupled.

The first half shell 20 has a first cord hole 22, a first coupling wall 24, two positioning notches 26 and two retaining walls 28. The first cord hole 22 is provided at a top of the first half shell 20, through which a lift cord 12 is inserted and then knotted as shown in FIG. 3. The first coupling wall 24 extends outwardly from an inner periphery of a bottom of the first half shell 20 and is provided with a first coupling portion 242, which is realized in this preferred embodiment as two elongated through holes 242 spaced from each other at a predetermined distance. The two positioning notches 26 are recessedly formed on the inner surface of the first half shell 20 and located at two lateral sides of the first half shell 20. Each of the retaining walls 28 protrudes outwardly from the inner surface of the first half shell 20 and neighbors one of the positioning notches 26.

The second half shell 30 has an inner periphery contacted with an inner periphery of the first half shell 20, a second cord hole 32, two extension walls 34, a second coupling wall 36 and two positioning protrusions 38. The second cord hole 32 is provided at a top of the second half shell 30, through which a lift cord 12 is inserted and then knotted as shown in FIG. 3.

The extension walls 34 protrude from the top of the second half shell 30 and are urged against the top of the first half shell 20. The second coupling wall 36 extends outwardly from an inner periphery of a bottom of the second half shell 30 and is provided with a second coupling portion 362, which is realized in this preferred embodiment as two spaced blocks each having a triangular cross-section and being engaged in one of the elongated through holes 242. The positioning protrusions 38 protrude outwardly from an inner surface of the second half shell 30 and are located at two lateral sides of the second half shell 30. Each positioning protrusion 38 is inserted into one of the positioning notches 26 of the first half shell 20 and abutted against one of the retaining walls 28 of the first half shell 20.

Figure 4:
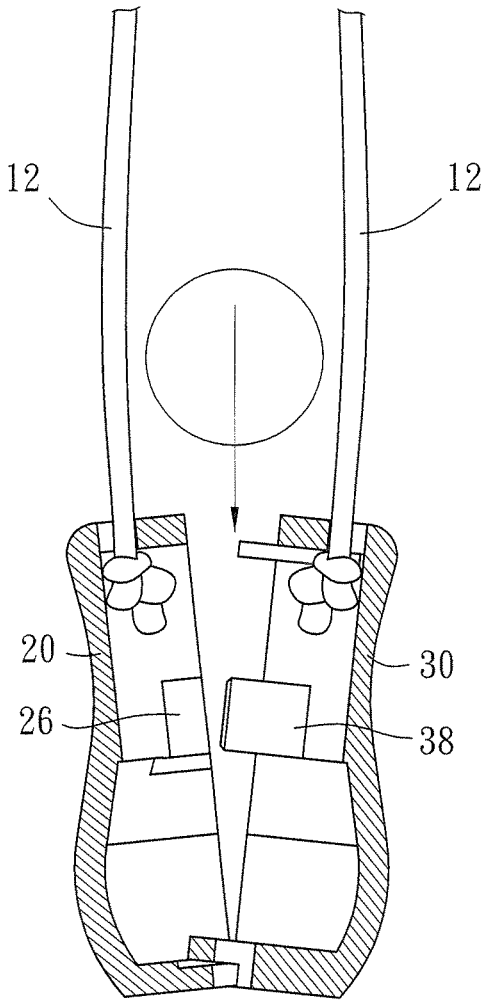
FIG. 4 is similar to FIG. 3 but showing that positioning protrusion of the second half shell is separated from the positioning notch of the first half shell.
Figure 5:
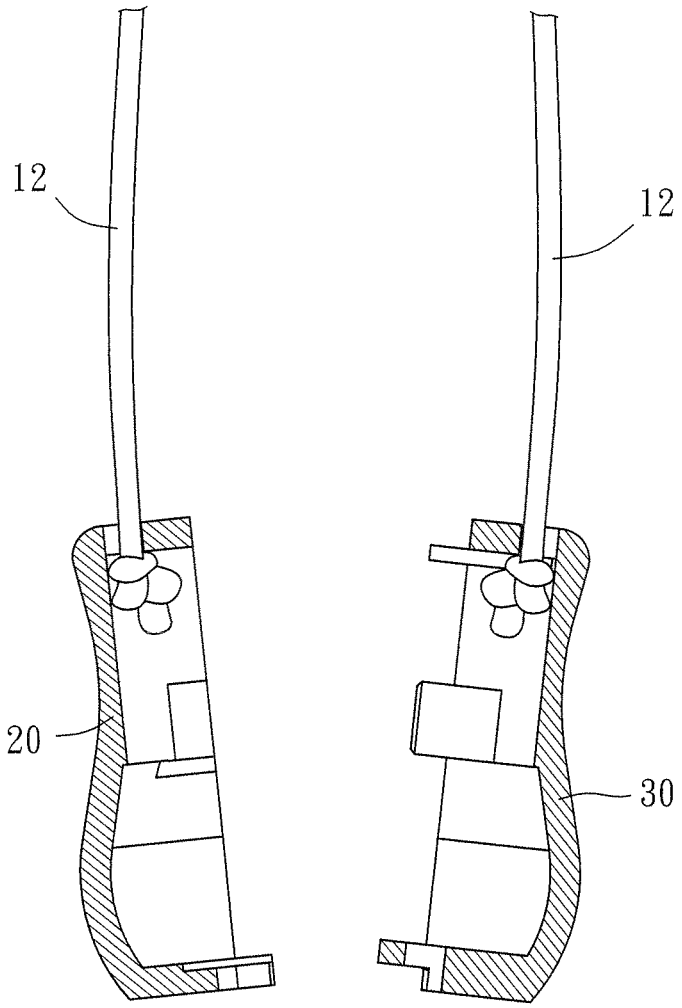
FIG. 5 is similar to FIG. 4 but showing that the first and second half shells are separated from each other.

When a foreign object, e.g. the neck of a child, enters the loop defined by the two cords 12 and the safety connector 10 and moves downwardly to press on the safety connector 10, the positioning protrusions 38 of the second half shell 30 will be forced to separate away from the positioning notches 26 of the first half shell 20 if the pressing force exerting on the safety connector 10 exceeds the engaging force between the positioning protrusions 38 and the positioning notches 26. At the same time, the first and second half shells 20 and 30 will be gradually separated from each other, as shown in FIG. 4. As a result, the coupling relationship between the first coupling portion comprising holes 242 of the first half shell 20 and the second coupling portion 362 of the second half shell 30 will be released, resulting in that the initially combined first and second half shells 20 and 30 will be eventually split from each other, as shown in FIG. 5. In this situation, the two lift cords 12 will be respectively connected with the separated first and second half shells 20 and 30; in other words, the loop will no longer exist, preventing the child's neck from hanging on the cords 12 so as to enhance the safety in use.

Figure 6:
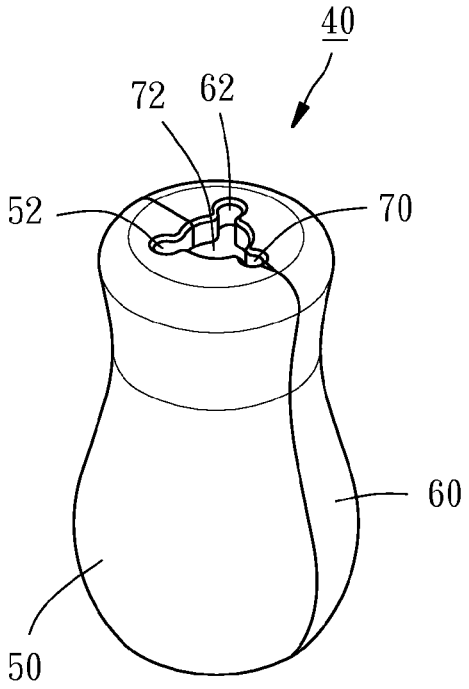
FIG. 6 is a perspective view of a connector in accordance with a second preferred embodiment of the present invention.
Figure 7:
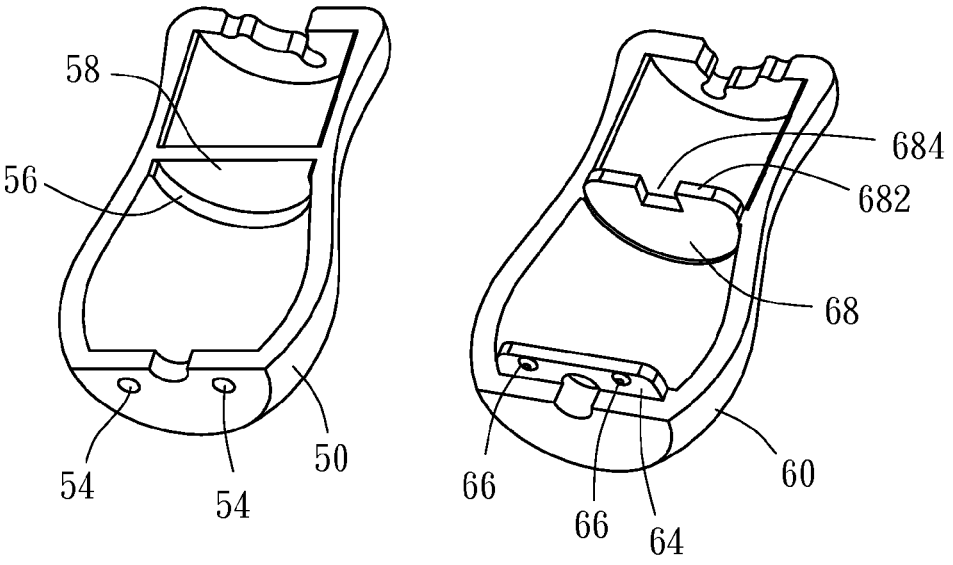
FIG. 7 is an exploded view of the connector shown in FIG. 6.

FIGS. 6-7 show a safety connector 40 in accordance with a second preferred embodiment of the present invention, which comprises a first half shell 50 and a second half shell 60 for connecting three cords 12.

Figure 8:
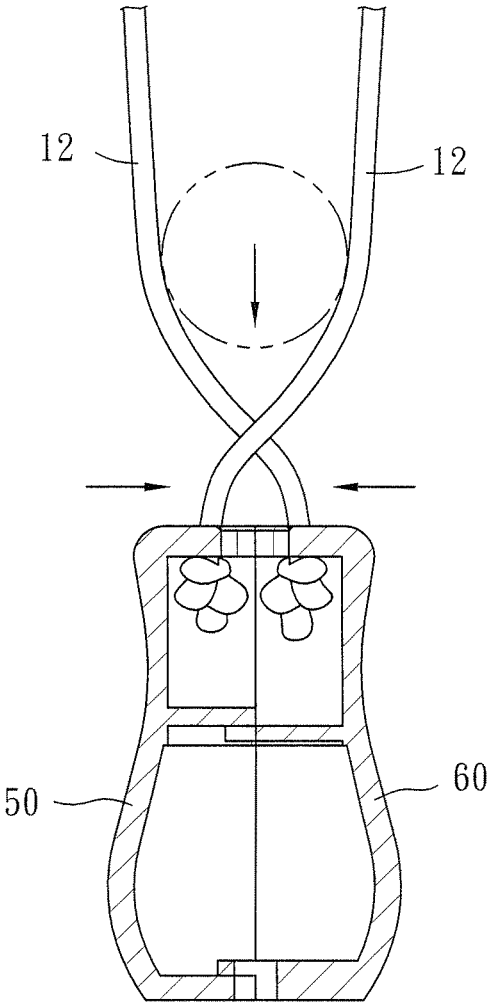
FIG. 8 is a cross-sectional view of the connector of FIG. 6, with which cords are coupled in a crossed manner.

The first half shell 50 has a first cord hole 52, a first coupling portion including holes or concavities 54, a positioning notch 56 and a retaining wall 58. The first cord hole 52 is provided at a top of the first half shell 50, through which a lift cord 12 is inserted and then knotted as shown in FIG. 8. In this preferred embodiment, the first coupling portion is realized as the two through holes or concavities 54 provided at the bottom of the first half shell 50 and spaced from each other at a predetermined distance. The positioning notch 56 is recessedly formed on the inner surface of the first half shell 50 and located between two lateral sides of the first half shell 50. The retaining wall 58 protrudes outwardly from the inner surface of the first half shell 50 and neighbors the positioning notch 56.

The second half shell 60 has an inner periphery contacted with an inner periphery of the first half shell 50, a second cord hole 62, a coupling wall 64 and a positioning protrusion 68. The second cord hole 62 is provided at a top of the second half shell 60, through which a lift cord 12 is inserted and then knotted as shown in FIG. 8. The coupling wall 64 extends outwardly from an inner periphery of a bottom of the second half shell 60 and is abutted with the bottom of the first half shell 50 and provided with a second coupling portion 66, which is realized in this preferred embodiment as two spaced convexities engaged with the through holes or concavities of the first coupling portion 54 respectively. The positioning protrusion 68 protrudes outwardly from an inner surface of the second half shell 60 and is located between two lateral sides of the second half shell 60. The positioning protrusion 68 has an urging end 682 protruding over the inner periphery of the second half shell 60 and is inserted into the positioning notch 56 of the first half shell 50 and abutted against the retaining wall 58 of the first half shell 50. In addition, the urging end 682 of the positioning protrusion 68 has a cut 684, such that the urging end 682 of the positioning protrusion 68 is flexibly deformable for enhancing the convenience in assembly.

Figure 9:
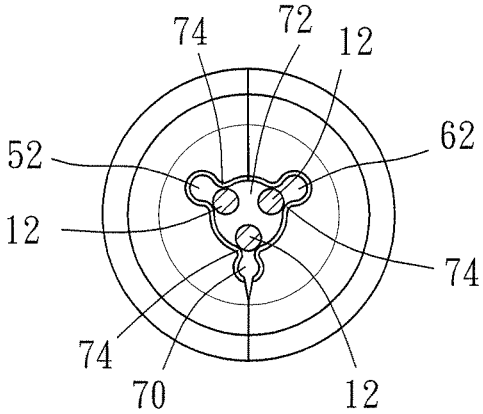
FIG. 9 is a top view of the connector of FIG. 6, showing that the cords are moved towards the through hole.

On the other hand, a third cord hole 70, through which a cord 12 is inserted, is defined between the tops of the first and second half shells 50 and 60 and communicated with the first and second cord holes 52 and 62 through a through hole 72 defined between the tops of the first and second half shells 50 and 60 in such away that a cord engaging portion 74 having a width smaller than a diameter of the cord 12 is defined between each of the first, second and third cord holes 52, 62 and 70 and the through hole 72, as shown in FIG. 9.

Figure 10A:
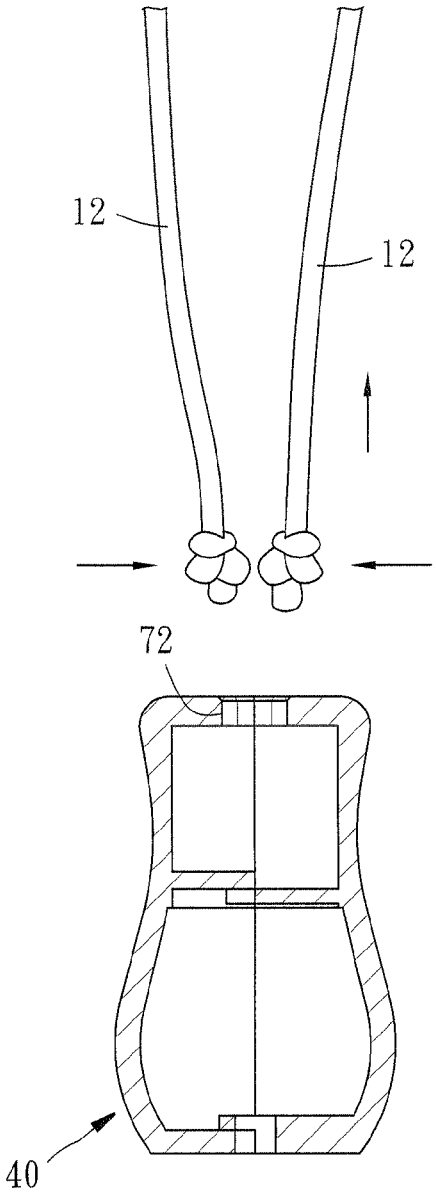
FIG. 10A is similar to FIG. 8 but showing that the cords are separated from the connector directly.
Figure 10B:
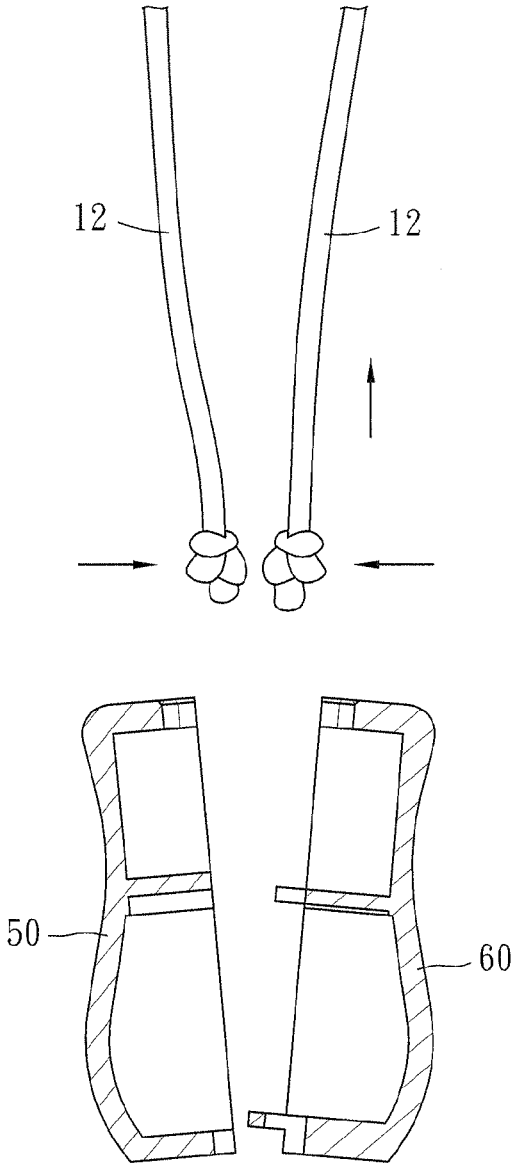
FIG. 10B is similar to FIG. 10 but showing that the first and second half shells are separated from each other.

When a foreign object, e.g. the neck of a child, enters the loop defined by three cords 12, which are crossed with each other as shown in FIG. 8, and the safety connector 10 and then moves downwardly to press on the cords 12, the cords 12 that receive the pressing force will move from the cord holes 52, 62 and 70 towards the through hole 72, and then the cords 12 may escape from the safety connector 40 through the through hole 72, as shown in FIG. 10A, if the external force exerting on the cords 12 overcomes the resistances of the cord engaging portions 74 to enabling the cords 12 to pass through the cord engaging portions 74, as shown in FIG. 9. On the other hand, the first and second half shells 50 and 60 may be separated from each other if the cords 12 are respectively jammed in the cord engaging portions 74, and after separation of the first and second half shells 50 and 60 the cords 12 may escape from the first and second half shells 50 and 60 through the through hole 72, as shown in FIG. 10B. In either event, it can prevent the user's neck from being hung on the cords 12.

Figure 11:
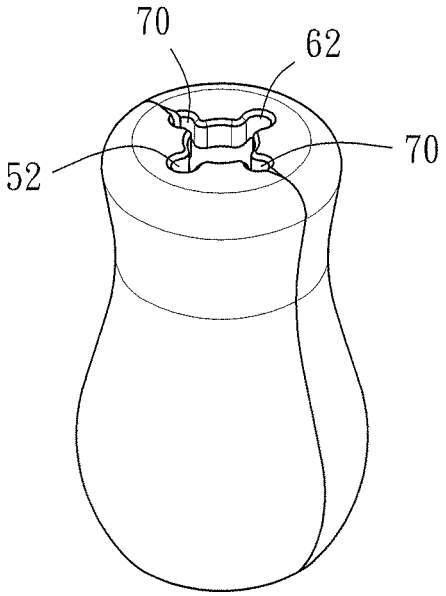
FIG. 11 is a perspective view of an alternate form of the connector according to the second preferred embodiment of the present invention, showing that the connector has four cord holes.

It is to be understood that the number of the third cord hole 70 is not limited to one. For example, as shown in FIG. 11, the safety connector of the present invention can provide two third cord holes 70, i.e. the connector can be configured having four cord holes 52, 62 and 70. In addition, the features disclosed in the two preferred embodiments of the present invention can be selectively and/or hybridly adopted in designing a safety connector of the present invention. For example, in the safety connector of second preferred embodiment of the present invention, the coupling structure disclosed in the first preferred embodiment, i.e. the elongated through hole and block, can be used to substitute for the concavity and convexity originally used in the second embodiment, the positioning structure of the first preferred embodiment, the positioning notch and positioning protrusion, can be used to substitute for the positioning structure used in second embodiment, and the top of the second half shell can be provided with an extension wall as the safety connector of the first embodiment does.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A safety cord connector for a window blind, comprising:

a first half shell having a top with a cord hole, a bottom with a first coupling portion, and an inner surface on which at least one positioning notch is provided, and a second half shell having an inner periphery contacted with an inner periphery of the first half shell, a top with a cord hole, a bottom with a second coupling portion detachably coupled with the first coupling portion, and an inner surface from which at least one positioning protrusion that is inserted into the at least one positioning notch extends;

wherein the first coupling portion of the first half shell comprises an elongated through hole and the second coupling portion of the second half shell comprises a block having a triangular cross-section and engaged in the elongated through hole.

2. The safety cord connector of claim 1, wherein the first half shell comprises two of said at least one positioning notches arranged respectively at two lateral sides of first half shell, and the second half shell comprises two of said at least one positioning protrusions arranged respectively at two lateral sides of the second half shell and inserted one to one into the two positioning notches.

3. The safety cord connector of claim 1, wherein the bottom of the first half shell comprises a first coupling wall provided with the first coupling portion and the bottom of the second half shell comprises a second coupling wall provided with the second coupling portion and abutted with the first coupling wall.

4. The safety cord connector of claim 1, wherein the second half shell comprises an extension wall protruding from the top of the second half shell and urged against the top of the first half shell.

5. The safety cord connector of claim 1, wherein the first half shell comprises a retaining wall neighbored to the positioning notch and urged against the positioning protrusion.

6. The safety cord connector of claim 1, wherein the first half shell comprises a retaining wall neighbored to the positioning notch and urged against the positioning protrusion.

7. A safety cord connector for a window blind, comprising:

a first half shell having a top with a cord hole, a bottom with a first coupling portion, and an inner surface on which at least one positioning notch is provided, a second half shell having an inner periphery contacted with an inner periphery of the first half shell, a top with a cord hole, a bottom with a second coupling portion detachably coupled with the first coupling portion, and an inner surface from which at least one positioning protrusion that is inserted into the at least one positioning notch extends; and a cord hole defined between the tops of the first and second half shells and communicated with the cord holes of the tops of the first and second half shells through a through hole defined between the tops of the first and second half shells; wherein a cord engaging portion is defined between each of the cord holes and the through hole and has a width smaller than a diameter of a cord to be used in the window blind.

* * * * *